US007869756B2

(12) United States Patent
Kaneko et al.

(10) Patent No.: US 7,869,756 B2
(45) Date of Patent: Jan. 11, 2011

(54) BOOKBINDING APPARATUS AND IMAGE FORMING SYSTEM PROVIDED THEREWITH

(75) Inventors: Masahiro Kaneko, Hino (JP); Tsuyoshi Tsuchiya, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 579 days.

(21) Appl. No.: 11/906,902

(22) Filed: Oct. 4, 2007

(65) Prior Publication Data

US 2008/0106023 A1 May 8, 2008

(30) Foreign Application Priority Data

Nov. 6, 2006 (JP) ..... 2006-300021

(51) Int. Cl.
*G03G 15/00* (2006.01)

(52) U.S. Cl. ..... 399/408; 399/407

(58) Field of Classification Search ..... 399/407, 399/408

See application file for complete search history.

(56) References Cited

U.S. PATENT DOCUMENTS 3,980,514 A * 9/1976 Rosette et al. ..... 156/539
5,632,853 A * 5/1997 Montandon et al. ..... 156/578
7,156,601 B2 * 1/2007 Cobene, II ..... 412/8
7,568,687 B2 * 8/2009 Sasamoto ..... 270/58.07

FOREIGN PATENT DOCUMENTS

JP 2000-168265 A 6/2000
JP 2004-209869 A 7/2004

* cited by examiner

*Primary Examiner*—Anthony H. Nguyen
(74) *Attorney, Agent, or Firm*—Holtz, Holtz, Goodman & Chick, PC

(57) ABSTRACT

A bookbinding apparatus including an adhesive coating section which coats an adhesive onto a spine of a sheet bundle that a plurality of sheets are bundled, by relatively moving the adhesive coating section and the sheet bundle, adheres a cover sheet onto the spine of the sheet bundle onto which the adhesive has been coated by the adhesive coating section. The adhesive coating section includes: a coating member which coats the adhesive storing in ah adhesive tank onto the spine of the sheet bundle; a scraping member which scrapes the adhesive coated onto the spine of the sheet bundle; and a reservoir which stores the adhesive scraped by the scraping member.

4 Claims, 10 Drawing Sheets

BOOKBINDING APPARATUS AND IMAGE FORMING SYSTEM PROVIDED THEREWITH

This application is based on Japanese Patent Application No. 2006-300021 filed on Nov. 6, 2006, which is incorporated hereinto by reference.

BACKGROUND ON THE INVENTION

This invention relates to a bookbinding apparatus for forming a booklet by gluing a sheet bundle with a cover sheet and an image forming system including the bookbinding apparatus.

Unexamined Japanese Patent Application Publication No. 2004-209869 discloses an bookbinding apparatus for simply conducting a wrapping bookbinding process by covering a bundle of a plurality of sheets (it is called book sheets) onto which an image has been formed by a copier and a printer, in a U-shape by a cover sheet, and gluing the cover sheet onto the spine of the sheet bundle.

An example of a book formed by a bookbinding apparatus will be illustrated in FIGS. 10(*a*) to 10(*c*). FIG. 10(*a*) illustrates a bundle of book sheets and cover sheet S2. FIG. 10(*b*) illustrates a situation where adhesive (glue) is coated on the spine of the bundle of book body sheets S1 and the cover sheet S2 is adhered thereto. FIG. 10(*b*) illustrates where the cover sheet S2 is not folded. FIG. 10(*c*) illustrates a situation where the cover sheet S2 has been folded. S3 is structured by the book body sheets S1 of a plurality of sheets and the cover sheet S2 so that the cover sheet S2 covers the book body sheets S1 in a U-shape style. The style of the book like S3 is called a wrapping book.

The coating amount of adhesive when coating the adhesive onto the spine of the book body sheets S1 is a key management point, which affects the finishing. In case when the coating amount is less, adhesive force is insufficient. In case when the coating amount is too much, the adhesive spreads around the spine. As a result, due to the excessive adhesive, the quality of the book becomes inferior.

In order to solve this problem, Unexamined Japanese Patent Application Publication No. 2000-168265 discloses a bookbinding apparatus for adjusting a quantity of adhesive by structuring the bookbinding apparatus to provide a scraping roller for scrapping coated adhesive together with a coating roller for coating the adhesive and to change the height of the scraping roller to adjust the adhesive to be scraped corresponding to the thickness of the sheet bundle.

However, in the bookbinding apparatus disclosed in Unexamined Japanese Patent Application Publication No. 2000-168265, there is an effect that the scraping roller scrapes adhesive excessively coated by a coating roller. However there is no effect that the scraping roller applies the adhesive. Thus, in case when the coating amount of the adhesive by the coating roller is small, unevenness of the adhesive to the spine of the sheet bundle occurs. As a result, quality inferior, such as, wrinkles appear on the spine of the sheet bundle.

SUMMARY OF THE INVENTION

One aspect of the present invention is as follows.

(1) A bookbinding apparatus for adhering a cover sheet onto a spine of a sheet bundle onto which adhesive has been coated, the bookbinding apparatus including an adhesive coating section for coating the adhesive onto the spine of the sheet bundle by relatively moving the adhesive coating section and the sheet bundle, wherein the adhesive coating section includes a coating member for coating the adhesive storing in an adhesive tank onto the spine of the sheet bundle, a scraping member for scraping adhesive coated onto the spine of the sheet bundle, and a reservoir for storing the scraped adhesive by the scraping member.

Another aspect of the present invention is as follows.

(2) An image forming system including an image forming apparatus for forming an image; and the bookbinding apparatus described in above item (1), the bookbinding apparatus forming a booklet by binding a plurality of sheets ejected from the image forming apparatus.

DETAILED DESCRIPTION OF PREFERRED EMBODIMENT

A bookbinding apparatus and an image forming apparatus including the bookbinding apparatus of the present invention will be described by referring to drawings. However, the present invention is not limited to this embodiment.

Figure 1:
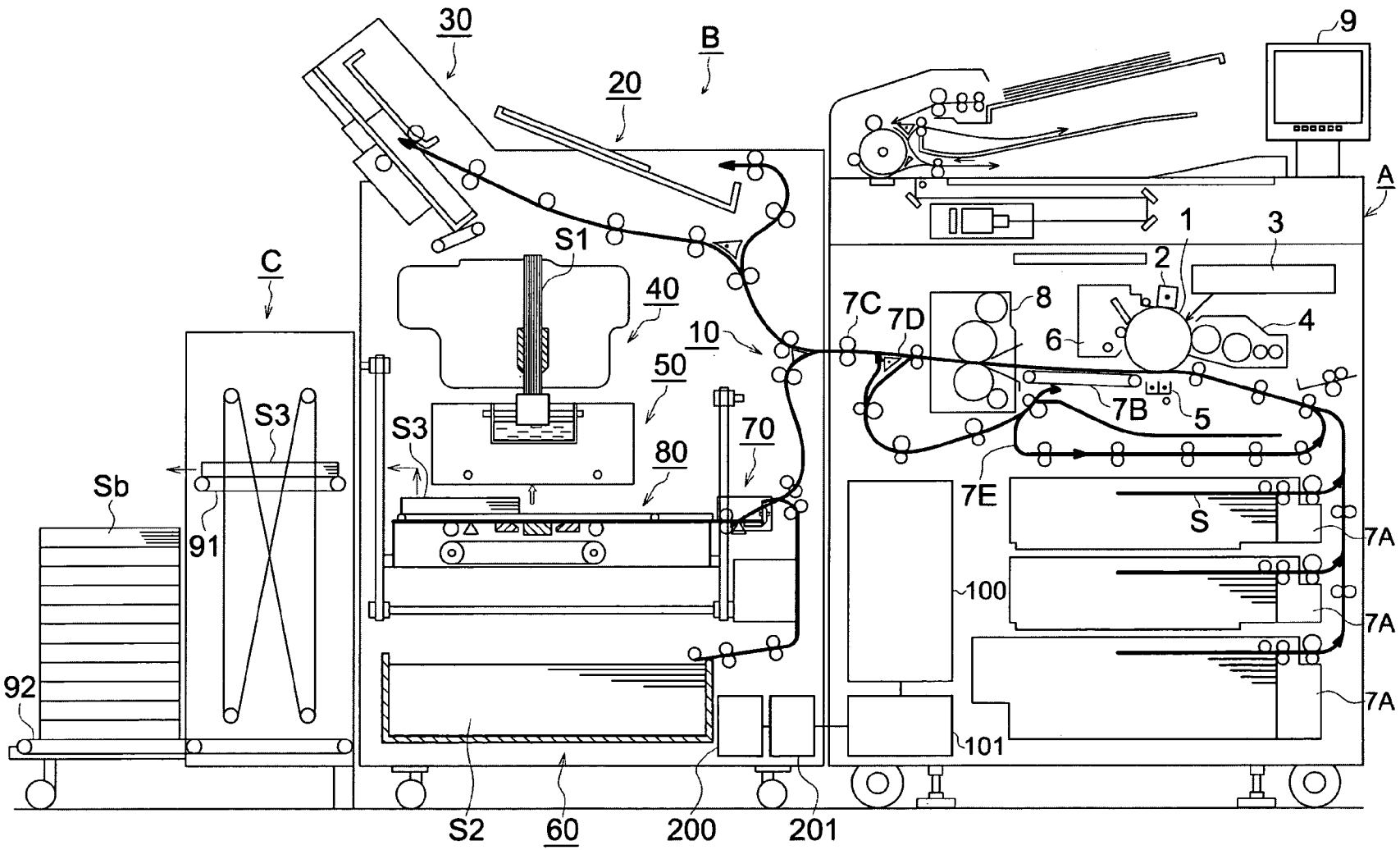
FIG. 1 illustrates a total configuration of a bookbinding apparatus pertaining to an embodiment of the present invention.

FIG. 1 illustrates a total configuration of a bookbinding system including an image forming apparatus A, a bookbinding apparatus (a post processing apparatus) B and a booklet storing apparatus C.

[Image Forming Apparatus A]

The image forming apparatus A includes a charging unit 2, an imagewise exposing unit 3, a developing unit 4, a transfer and discharging unit 5 and a cleaning unit 6, which are disposed around a rotary image carrier 1. An image forming device is arranged to conduct exposing and scanning based on the image data read out from a document by using the laser beam from the imagewise exposing unit 3 to form an latent image after uniformly charging electric charges on the image carrier 1 by the charging unit 2. The developing unit 4 forms a toner image on the surface of the image carrier 1 by reversibly developing the latent image.

A sheet S fed from a sheet storing section 7A is conveyed to a transfer position. After the transfer and discharging unit 5 has transferred the toner image onto the sheet S at a transfer point, the electric charges of the sheet S are deleted and the sheet S is separated from the image carrier 1. Then, a conveyance unit 7B conveys the sheet S, and the fixing unit 8 continuously heats and fixes the image onto the sheet S and an ejection rollers 7C eject the sheet S.

In case when forming an image of dual surfaces of the sheet S, the image forming apparatus A is arranged to branch the sheet S, which has been heated and onto which an image has been fixed by the fixing unit 8, from a normal-ejection-sheet-path by controlling a conveyance path switching member 7D, pass the sheet S through the image forming section again after having switched back and reversed the sheet S at a reversing and conveying section 7E, form an image on the rear surface of the sheet S, pass the sheet S through the fixing unit 8. The sheet S ejected from the ejection rollers 7C is conveyed into the bookbinding apparatus B.

The cleaning unit 6 removes the residing developing agent left on the surface of the image carrier 1 after having completed the image process to prepare the next image formation.

In the upper position of the image forming apparatus A, an operation section 9 including an input section and a display section is disposed.

[Bookbinding Apparatus B]

The bookbinding process of the bookbinding apparatus will be described by referring to FIGS. 1-6(*d*). As shown in FIG. 1, the bookbinding apparatus pertaining to the present invention includes a sheet conveying section 10, a sheet ejection section 20, a sheet bundle storing section 30, a sheet bundle conveying section 40, an adhesive coating section 50, a cover sheet supplying section 60, a cover sheet cutter 70 and a cover sheet holding section 80. These sections are roughly vertically disposed in a longitudinal direction.

The sheet conveying section 10 conveys the sheet S, onto which an image has been formed in the image forming apparatus A, to stack a plurality of sheets S to form a sheet bundle S1 at the sheet bundle storing section 30. The sheet bundle conveying section 40 conveys the sheet bundle S1 to a predetermined position and the bundle of sheet S1 is adhered with a cover sheet S2 supported by the cover sheet holding section 80 to execute a bookbinding process after the adhesive coating section 50 has coated the adhesive to the spine of the sheet bundle S1. The detail will be described hereinafter.

[Conveyance of Sheet S]

The sheet S guided by the sheet conveying section 10 is conveyed to any one of the sheet ejection section 20, the sheet bundle storing section 30 and the cover sheet holding section 80 by a plurality of conveyance rollers and a conveyance switching gate.

Once the sheet conveyance to the sheet ejection section 20 has beet set, an ejection tray of the sheet ejection section 20 directly receives the sheet S ejected from the image forming apparatus A. Maximum about two hundred sheets can be stacked onto the ejection tray.

[Formation Process for Sheet Bundle S1]

Figure 2:
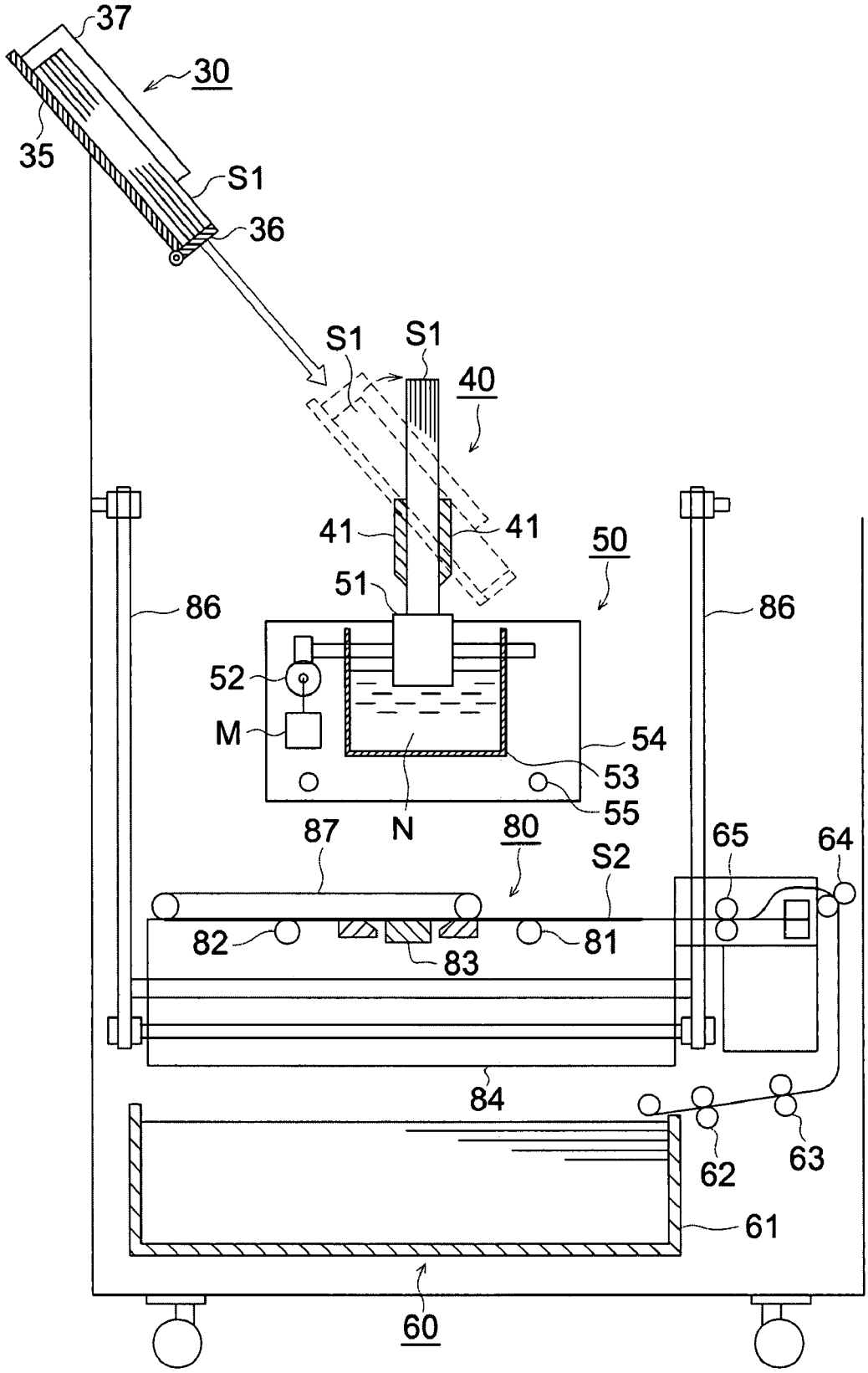
FIG. 2 illustrates a cross sectional view of a sheet bundle conveyance device and an adhesive coating section.

The sheet bundle storing section 30 binds the sheets S ejected from the image forming apparatus A when having stacked a predetermined number of sheets to form a sheet bundle S1. As illustrated in FIG. 2, the sheet bundle storing section 30 includes a sheet placing table 35 provided in a slant posture, a sheet rear edge position determination member 36, which is capable of moving, and an aligning member 37 for aligning the sheet in a width direction.

[Conveyance Process of Sheet Bundle S1 and Cover Sheet S2]

As illustrated in FIG. 2, after the sheet bundle S1 stacked on the sheet placing table 35 of the sheet bundle storing section 30 has been aligned, the sheet bundle S1 will be bound by an interposing member 41. The sheet rear edge position determination member 36 will be swung by a driving device (not shown) to retreat under the sheet placing table 35. The interposing member 41 binding the sheet bundle S1 rotates after having moved to lower direction as illustrated in a dashed line so that the spine Sa of the sheet bundle S1, onto which an adhesive coating process is applied, positions at a lower side and the sheet bundle S1 is kept in vertical posture, and stops in a predetermined position.

On the other hand, the cover sheet S2 stored in a cover sheet loading section 61 in a cover sheet feeding section 60 is separated and conveyed by the sheet feeding section 62, interposed by the conveyance rollers 63, 64 and 65, conveyed by conveyance rollers 81 and 82 of the cover sheet holding section 80 and stopped at a predetermined position.

The cover sheet cutter 70 disposed in the right side of the conveyance roller 65 illustrated in FIG. 2 is arranged to cut the cover sheet S2. In case when the length of the cover sheet S2 is longer than the necessary length when conducting a cover sheet bookbinding process against the sheet bundle S1, the cover sheet cutter 70 cuts the unnecessary portion in advance.

[Adhesive (Glue) Coating Process for Sheet Bundle]

Figure 3:
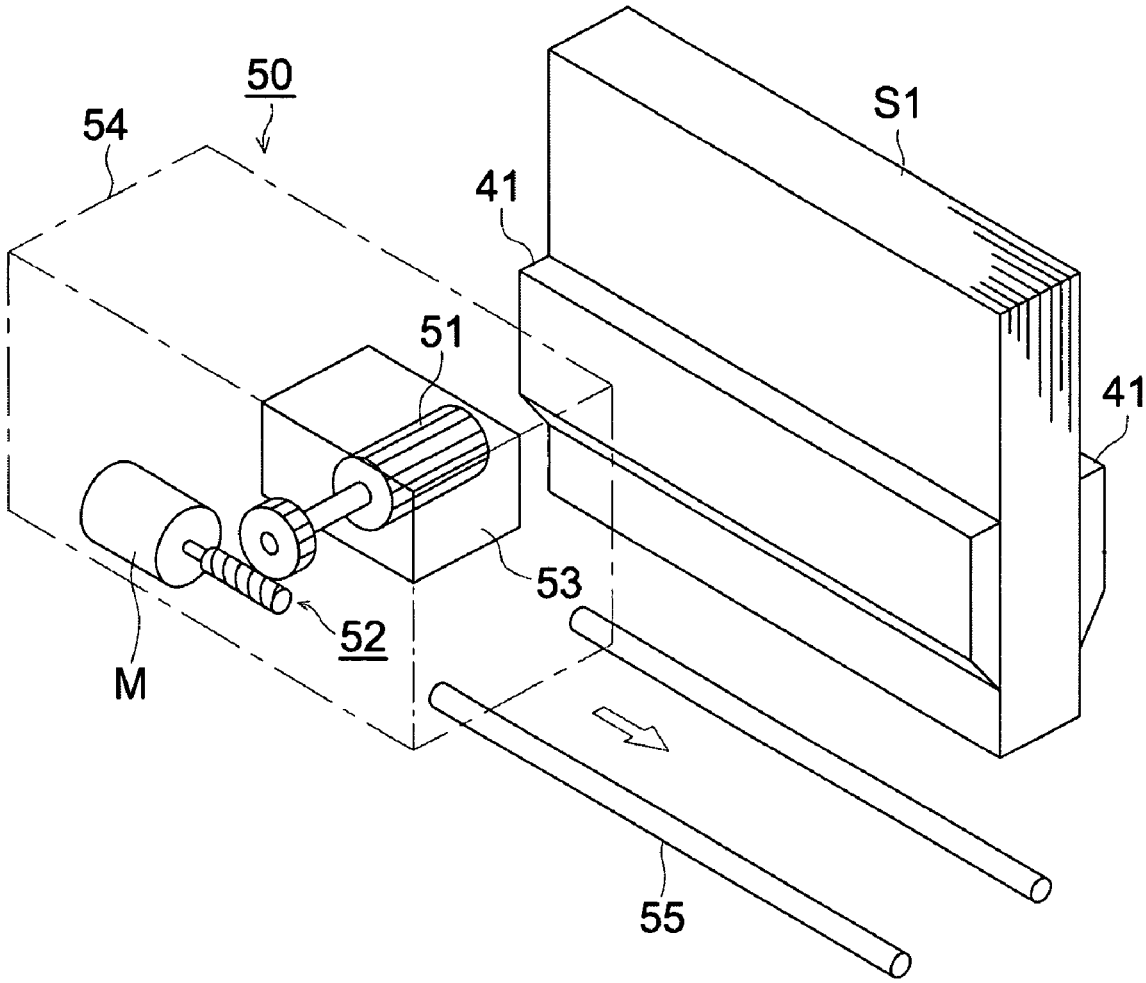
FIG. 3 illustrates a bird eye view of an adhesive coating section and a interposing section.
Figure 4:
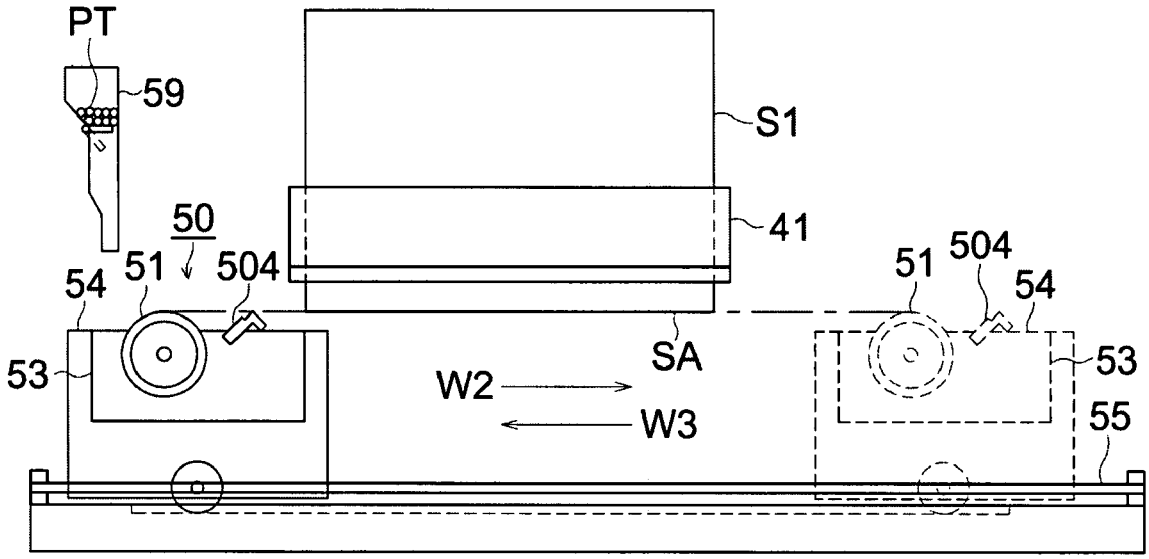
FIGS. 4(*a*) and 4(*b*) illustrate a side view and a plan view of the adhesive coating section, respectively.
Figure 4:
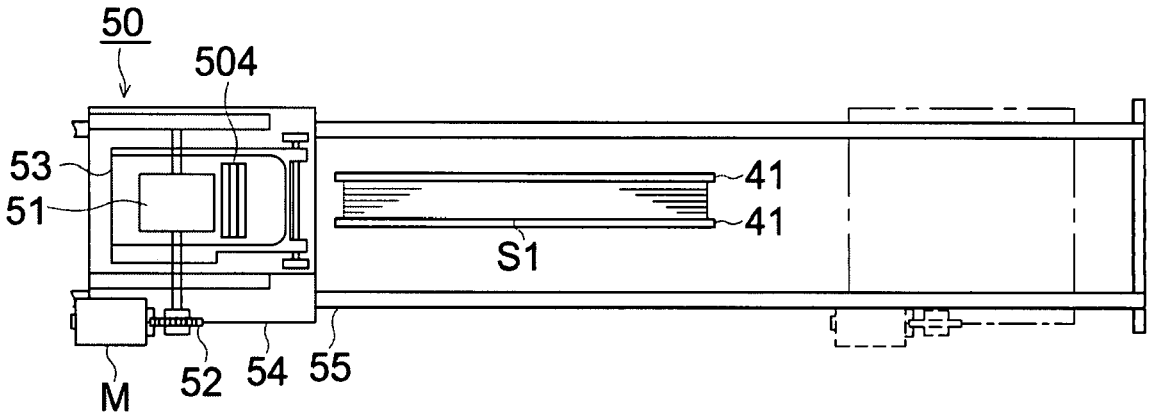

FIG. 3 illustrates a bird eye view of an adhesive coating section 50 and the interposing member 41. FIG. 4 illustrates an outline drawing showing the adhesive coating section 50. FIG. 4(*a*) illustrates a side view of the adhesive coating section 50 and the interposing member 41 viewed from the left side direction of FIG. 2. FIG. 4(*b*) illustrates a side view of the adhesive coating section 50 and the interposing member 41 viewed from the upper direction of FIG. 2.

Numeral 51 denotes a coating roller for coating adhesive, and numeral 504 denotes a scraping section for leveling the adhesive and scraping excessive adhesive. The width in the shaft direction of the coating roller 51 is set wider than the maximum thickness of the bundle of sheet S1, to which the bookbinding process can be coated. For example, in this embodiment, the width in the shaft direction of the coating roller 51 has been set 40 mm. Further, the width of the scraping section is set longer in width than that of coating roller 51. In this embodiment, for example, it is set 50 mm (refer to FIG. 4(*b*)).

Numeral 53 denotes an adhesive tank for storing adhesive. Numeral 54 denotes a moving member for supporting the adhesive tank 53. The moving member 54 starts moving from an initial position in the rear side of the bookbinding apparatus B (the left edge of FIG. 4(*a*)) to a W2 direction. The moving member 54 moves along the guide 55 and returns to the initial position when it is reversibly driven in a W3 direction after stopping at a predetermined position, which is a front surface side of the bookbinding apparatus B.

Numeral 59 denotes a supply apparatus for supplying adhesive. The supply apparatus 59 supplies a lump of adhesive (it will be called a pellet hereinafter) PT based on the signal of a sensor (numeral 506 in FIG. 7(*a*)) for detecting the adhesive amount of an adhesive tank 53. A heater is provided on an outer circumference of the adhesive tank 53 and the inside of the coating roller 51. The adhesive lump is in a melting condition by heating the adhesive in the adhesive tank 53 at a predetermined temperature.

A motor M and a driving device 52 rotate the coating roller 51, which is dipped in the adhesive tank 53 storing adhesive N, in a predetermined direction. The coating roller 51 is arranged to apply the adhesive onto the spine Sa of the sheet bundle S1 held in a vertical posture in case when the moving member 54 returns (in a W3 direction in FIG. 4(*a*)) or when the moving member 54 reciprocally moves.

[Adhesion of Sheet Bundle and Cover Sheet]

Figure 5:
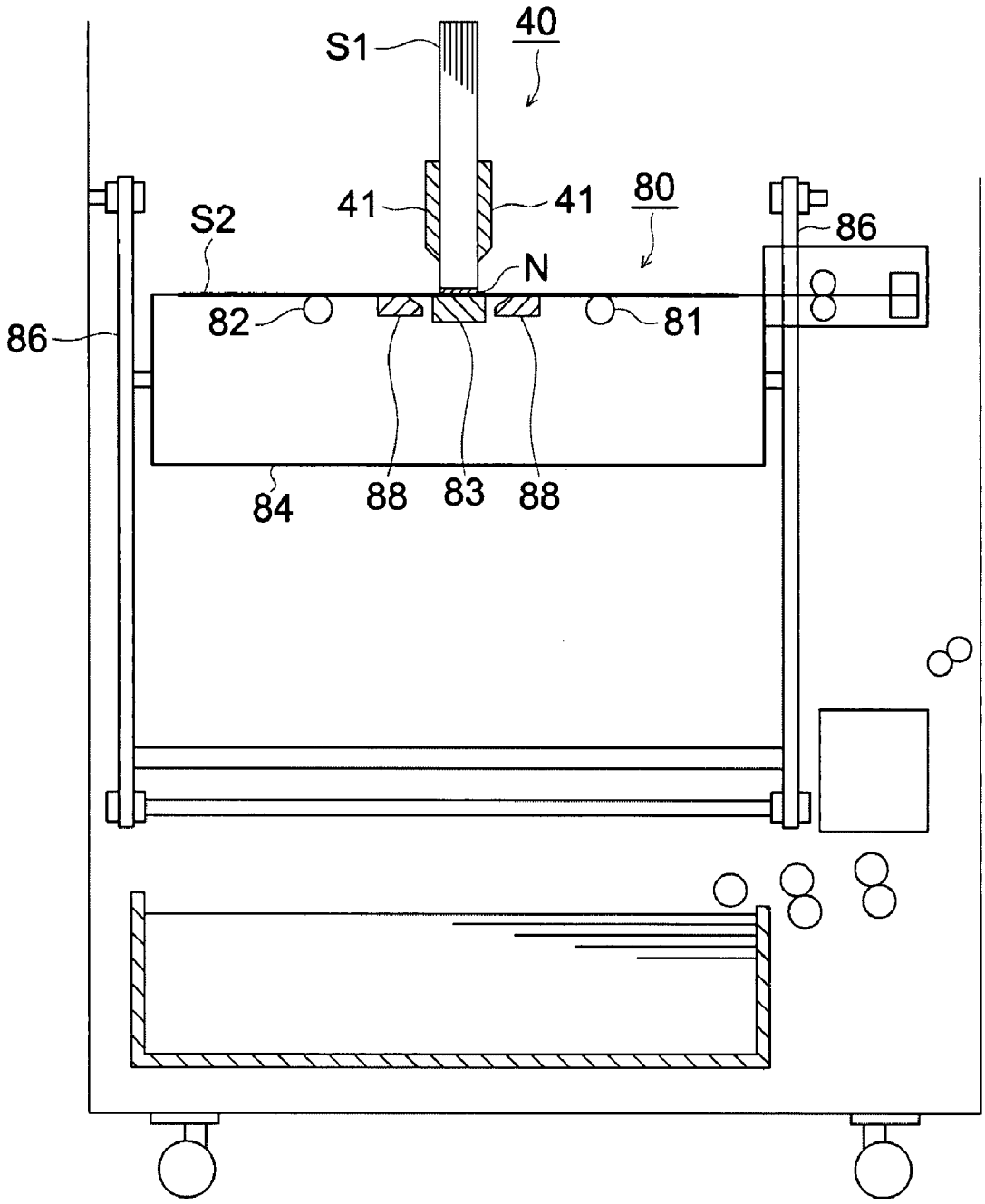
FIG. 5 illustrates a cross sectional view of the sheet bundle conveyance device when executing the adhesion process of the sheet bundle and the cover sheet and the cover sheet wrapping device.

FIG. 5 illustrates a cross sectional view of the sheet bundle conveying section 40 when executing the adhesion process of the sheet bundle S1 and the cover sheet S2 and the cover sheet holding section 80.

After having completed the adhesive coating process to the sheet bundle S1, a driving device (not shown) allows the up-and-down device 86 to move a frame body 84 to the upward position as a predetermined position. At this upward position, the center section of the cover sheet S2 placed on the pressing member 83 is pressed, contacted and adhered onto the adhesive coated surface of the sheet bundle S1.

[Folding of Cover Sheet]

Figure 6:
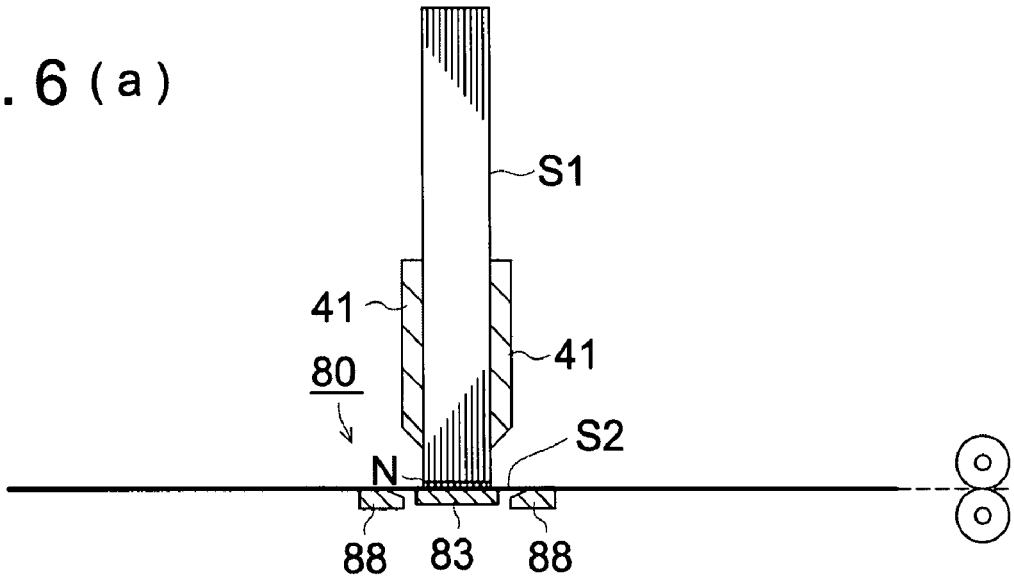
FIGS. 6(*a*) to 6(*d*) illustrate cross sectional views of the cover sheet wrapping device showing the folding process of the cover sheet and a sheet bundle.
Figure 6:
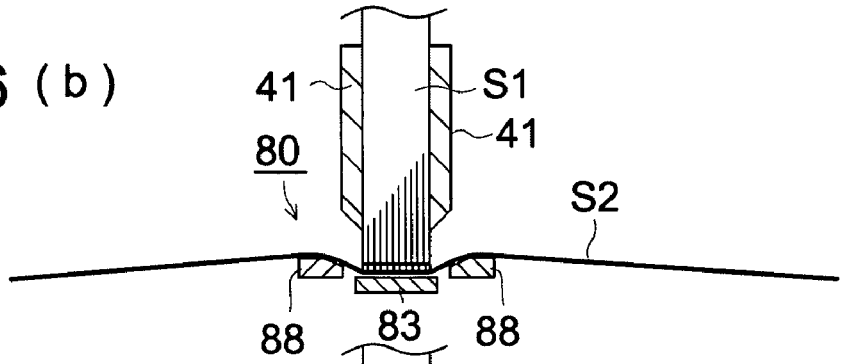
Figure 6:
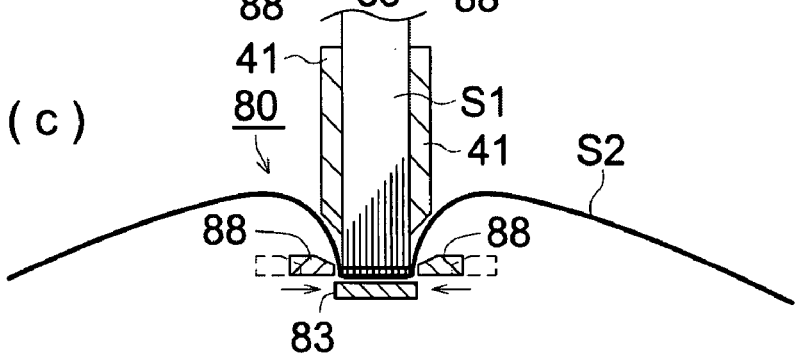
Figure 6:
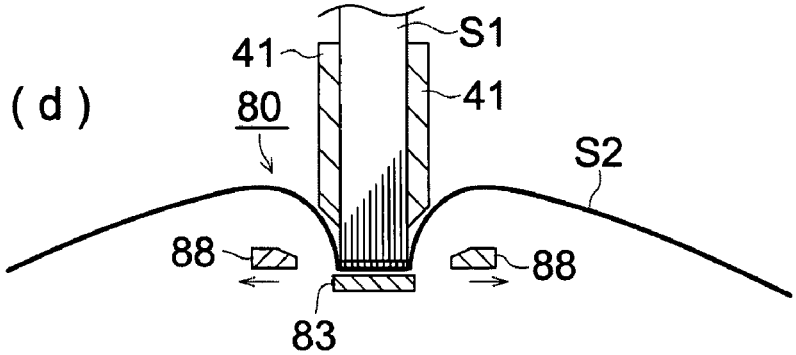

FIGS. 6(*a*) to 6(*d*) illustrate cross sectional views of the cover sheet holding section 80 showing the folding process of the cover sheet S2 and the sheet bundle S1. FIG. 6(*a*) illustrates the situation when starting folding the cover sheet, FIG. 6(*b*) illustrates the situation where the cover sheet folding is in a middle of the process, FIG. 6(*c*) illustrates the situation when having completed the cover sheet folding process and FIG. 6(*d*) illustrates the situation where the cover sheet folding pressure has been released.

After having adhered the cover sheet S2 onto the sheet bundle S1 onto which the adhesive N has been coated, a pair of folding members 88 is raised by a driving device (not shown) while the cover sheet support device illustrated in FIG. 5 stays in the upward position. The interposing member 41 binding the sheet bundle S1 descends. As the sheet bundle S1 descends, the cover sheet S2 interposed by the pair of folding members 88 descends and the cover sheet S2 is folded at the side edge sections of adhesive coated surface of the sheet bundle S1 (FIG. 6(*b*)).

After that, the pair of folding members 88 moves in a horizontal direction toward the adhesive coated surface side of the sheet bundle S1 to press and shape the both sides of the sheet bundle to form a booklet S3. The description above is a bookbinding process.

[Ejection Process]

The booklet S3 ejected by an ejection belt 87 will be placed on a conveyance belt 91, which is capable of moving up and down, in the booklet storing apparatus C as illustrated in FIG. 1, sequentially ejected by the rotation of the conveyance belt 91 and placed on an ejected sheet table 92 to be stored.

[Adhesive Coating Section]

Figure 7:
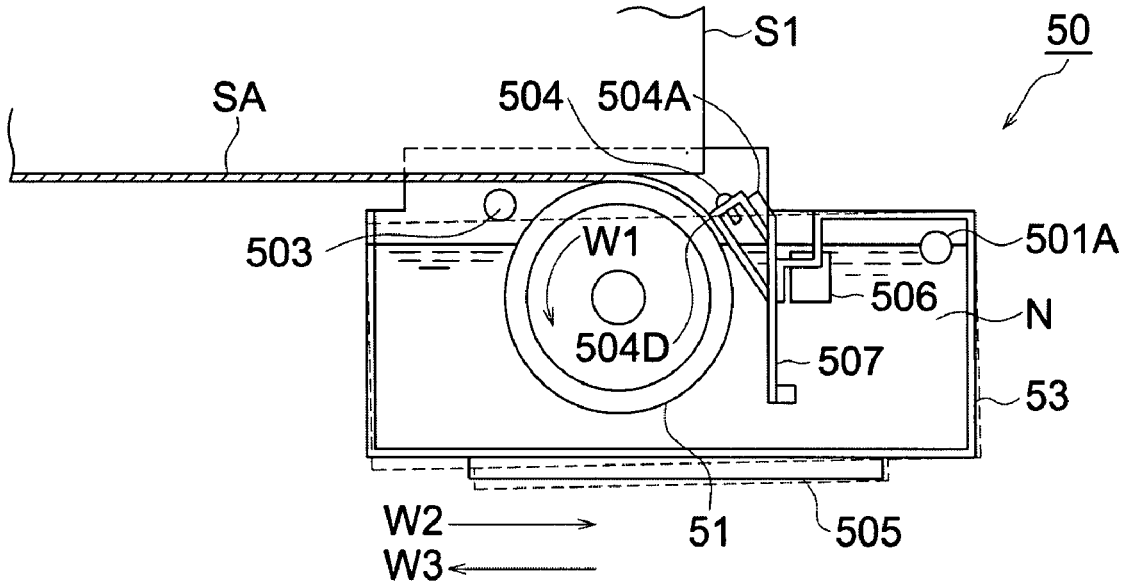
FIGS. 7(*a*) and 7(*b*) illustrate structural diagrams of the adhesive coating section pertaining to the embodiment.
Figure 7:
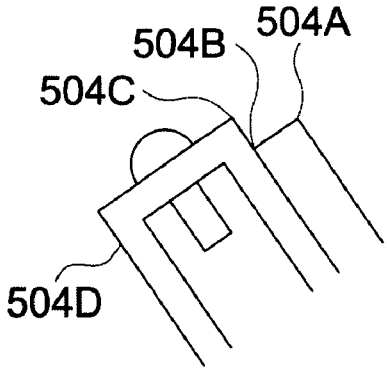

The adhesive coating section will be described in detail by referring to FIGS. 7(*a*) to 7(*b*) and 8(*a*) to 8(*c*). FIGS. 7(*a*) and 7(*b*) illustrate a main section of the adhesive coating section 50.

In FIG. 7(*a*), the adhesive coating section 50 includes the adhesive tank 53 for storing adhesive N, a coating roller 51 and a regulation member 503 as a coating member, a scraping section 504, a heater 505 and an adhesive amount sensor 506.

The heater 505 heats and melts the pellet PT supplied into the adhesive tank 53 to form coating liquid of adhesive N. The amount of the adhesive N is controlled so that the pellet PT is supplied from the supply apparatus 59 corresponding to the detection signal from the adhesive amount sensor 506 and the liquid surface of the adhesive N is kept constant. Numeral 503 denotes a regulation member having a bar shape in a cross sectional view and numeral 504 denotes a scraping section, which are fixed onto a support member 507 having a plate shape by screws in both edges outside the coating area. The adhesive tank 53 is arranged to rotate from a waiting state, which is illustrated in dashed line to a coating state, which is illustrated in a solid line centering on a shaft 501A.

[Scraping Section]

FIG. 7(*b*) illustrates an enlarged view of the scraping section 504. An edge section 504A, which is located in the most upper position is a scraping member (a main scraping member) and numeral 504C denotes an auxiliary scraping member. Numeral 504B denotes a storing section (a reservoir), which is provided between the coating roller 51 and the scraping member 504A (the main scraping member). Numeral 504D denotes a lower end edge portion for regulating the thickness of the layer of adhesive of the coating roller 51.

Here, the main scraping member 504A, the auxiliary scraping member 504C and the storing section 504B are respectively formed at the ridge portion of the edge and a valley portion on the plate folded into a W-shaped structure. The distance between the top surface of the regulation member 503, the coating roller 51 and the main scraping member 504A, and the spine SA is set practically the same, for example, 1 mm. The upper surface height of the auxiliary scraping member 504C is set with a step of 0.5 mm-3.0 mm against the main scraping member 504A (preferably about 1.0 mm). With respect to the horizontal direction, the upper surface height of the auxiliary scraping member 504C is provided 1 mm-8 mm, (preferably about 4 mm) apart from the main scraping member 504A. Further, with respect to the material of the scraping section is preferably a material having a high thermal conductivity, such as a cupper so that the coated adhesive tends to easily be melted.

The coating process of adhesive will be described in detail by using FIG. 8(*a*) to 8(*c*). The coating process is conducted by reciprocally moving the coating section 50 against the spine of the sheet bundle to apply the adhesive N. When moving forward (W2 direction), the regulation of coating amount of the adhesive N is mainly conducted by the regulation member 503. When moving backward (W3 direction), the regulation of coating amount of the adhesive N is mainly conducted by the scraping section 504. This operation will be described in detail hereinafter.

Figure 8:
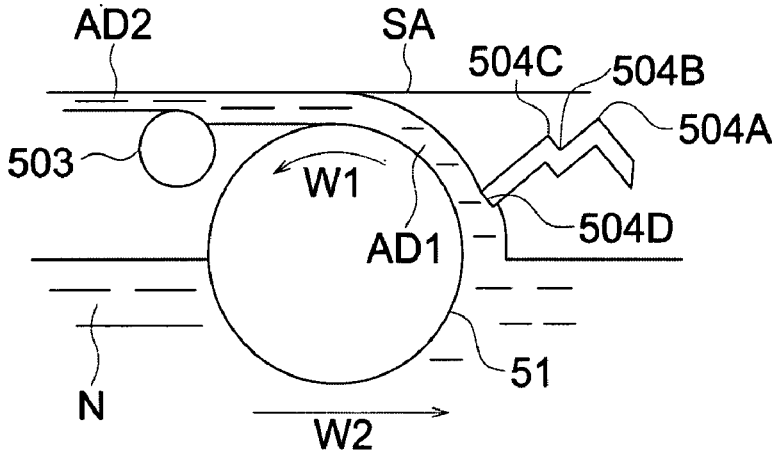
FIGS. 8(*a*) to 8(*c*) illustrate coating process of adhesive.
Figure 8:
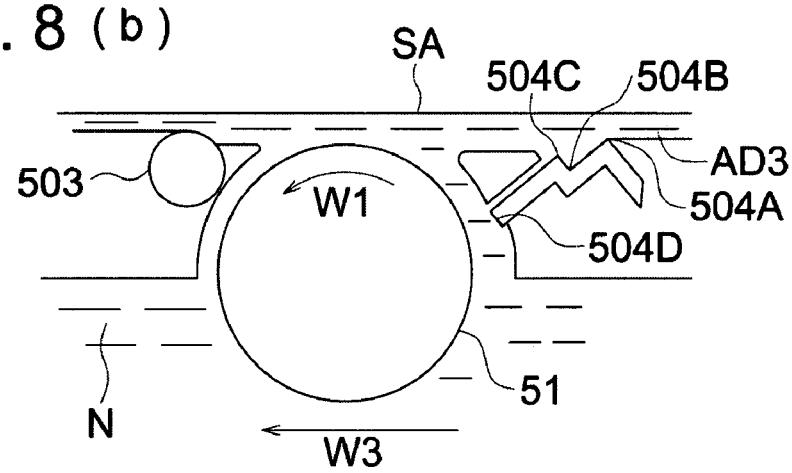
Figure 8:
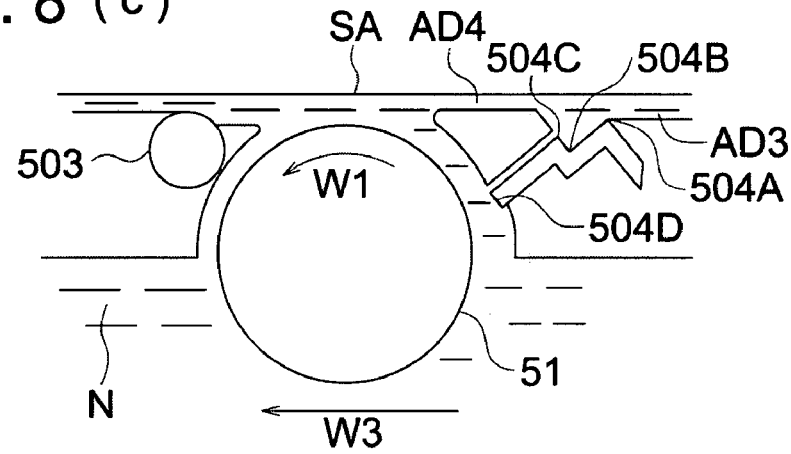

FIG. 8(*a*) illustrates the coating process when the adhesive coating section 50 moves forward in the W2 direction. When moving forward, the coating roller 51 rotates in an arrow direction W1 and at the same time the adhesive coating section 50 moves in the arrow direction W2 to coat the adhesive onto the spine SA of the sheet bundle. An adhesive layer AD1 on the coating roller 51 is regulated into a uniform thickness by a lower edge 504D of the scraping section 504. Further, the regulation member 503 regulates the adhesive layer formed on the spine SA of the sheet bundle so that the thickness of an adhesive layer AD2 can be uniformly controlled. The regulation member 503 is structured by a bar having a circular shape in a cross sectional view.

FIG. 8(*b*) illustrates a coating process when the coating section 50 moves back in the direction W3.

When moving back, the coating roller 51 rotates in the arrow direction W1 and coating is conducted. Firstly, the adhesive layer AD3 on the spine of a sheet bundle is weakly regulated by the auxiliary scraping member 504C disposed on the downstream side of the scraping direction. After that the adhesive layer AD3 on the spine of a sheet bundle is regulated by the main scraping member 504A disposed on the upstream side of the scraping direction.

Since the upper surface of the main scraping member 504A has been set higher than that of the auxiliary scraping member 504C, the distance to the spine SA of the sheet bundle from the upper surface of the main scraping member 504A is closer than that of the auxiliary scraping member 504C. Thus the regulation effect (scraping effect) becomes larger.

Since the storing section 504B is provided between the main scraping member 504A and the auxiliary scraping member 504C, the excessive adhesion agent N scraped by the main scraping member 504A can be temporarily stored in the storing section 504B. As illustrated in FIG. 8(C), even when the coating amount of the adhesive N by the coating roller 51 becomes partially small, since the adhesive is supplied from the storing section 504B, the adhesive layer AD4, which is insufficient in supply becomes an adhesive layer AD3 which is thick. Thus, it becomes possible to solve the problems of the supply insufficiency or unevenness of the adhesive N.

Further, in this embodiment, an example where the adhesive coating section 50 is reciprocally moved to apply the adhesive has been described. However, a structure where the adhesive coating section 50 may be arranged to conduct the adhesive coating operation only when the adhesive coating section 50 moved in one direction (W3 direction) may also be acceptable.

As described above, by configuring a bookbinding apparatus including a scraping member for scraping the coated adhesive after having coated adhesive onto the spine of a sheet bundle by a coating roller and, and a storing section for storing the scraped adhesive, it becomes possible to uniformly apply adhesive onto the spine of the sheet bundle. Further, it also becomes possible to provide a bookbinding apparatus for forming a high quality booklet and an image forming system including the bookbinding apparatus.

Figure 9:
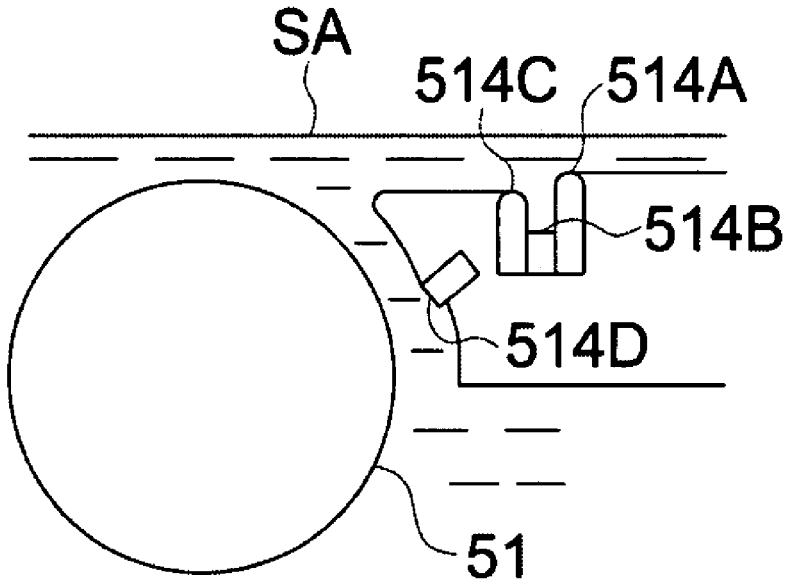
FIGS. 9(*a*) and 9(*b*) illustrate structural diagrams of an adhesive coating section pertaining to other embodiments.
Figure 9:
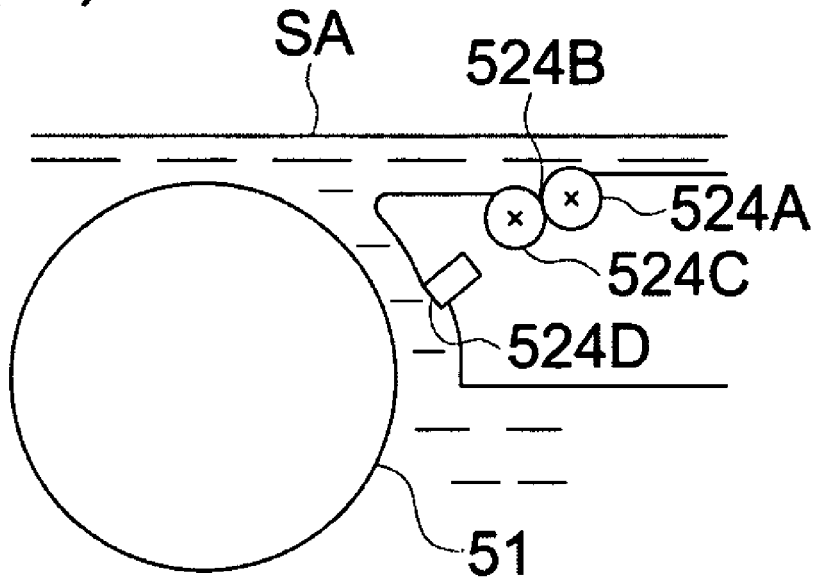
Figure 10:
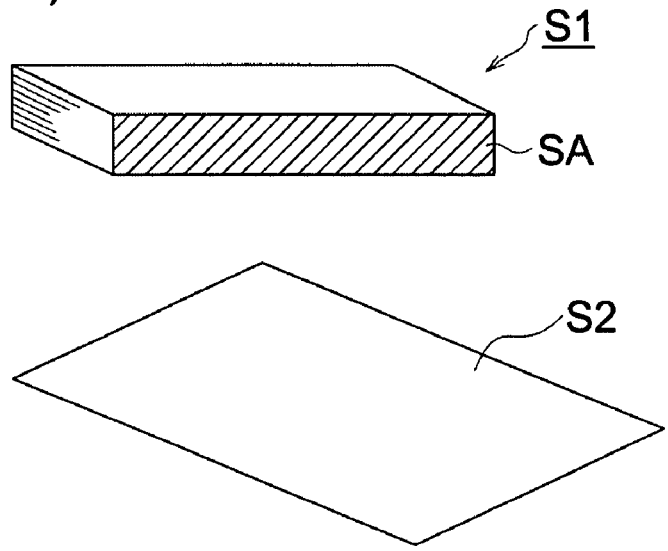
FIGS. 10(*a*) to 10(*c*) illustrate an example of a wrapping bookbinding formed by a bookbinding apparatus.
Figure 10:
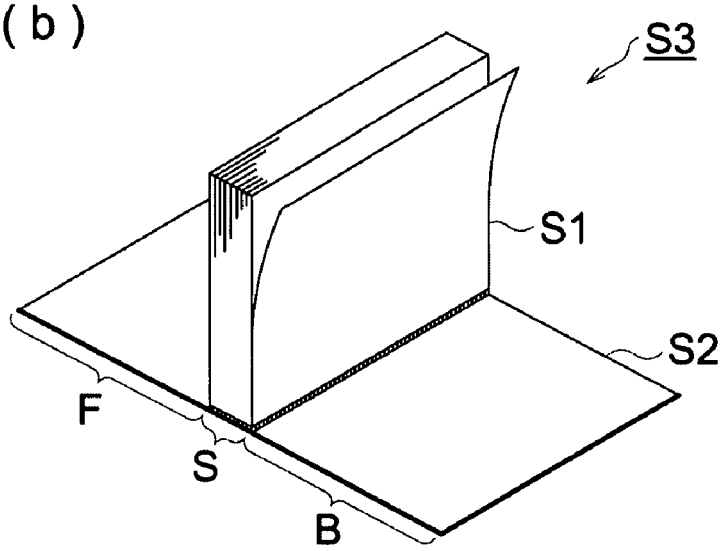
Figure 10:
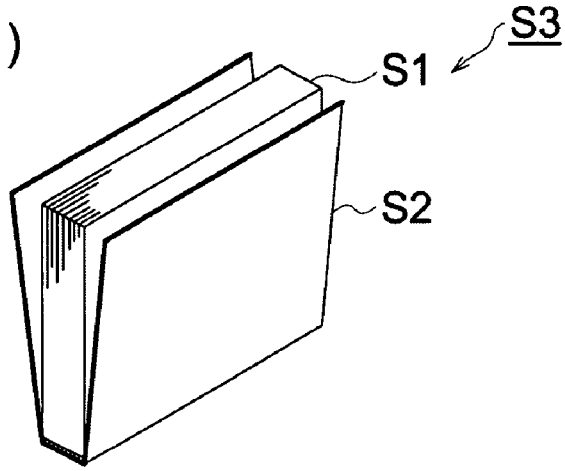

FIGS. 9(*a*) and 9(*b*) illustrate configurations of a scraping section pertaining to other embodiments. FIG. 9(*a*) illustrates an embodiment of a scraping section using two metal plates. FIG. 9(*b*) illustrates an embodiment using two metal bars having a substantially circle shape in a cross sectional view of the metal shaft. With respect to the other structures other than FIGS. 9(*a*) and 9(*b*), are the common with the structure illustrated in FIGS. 7(*a*) and 7(*b*).

In the scraping section 514 (514A-514D) illustrated in FIG. 9(*a*), by forming a step structure of the upper surface with two metal plates and adhering both of the two metal plates via a spacer, the respective metal plates can be arranged to function as a main scraping member 514A and an auxiliary scraping member 514C, and a hollow section structured by the spacer can be arranged to function as a storage section. Further, since the relative heights of 514A, 514B and 514C can be adjusted, the position adjustment of the upper surface of the scraping member and the depth of the storing section can be adjusted. In FIG. 9(*a*), the scraping members 514A and 514C are structured by metal plates and the respective front edges are planed off. The thickness of the metal plate is about 1 mm-3 mm and the two metal plates are adhered each other via a spacer having the thickness of 1 mm-8 mm with step difference of 0.5 mm-3 mm in an upper surface height.

Further, since the spacer does not need to be provided in all area in the longitudinal direction (a roller shaft direction), the spacer may be placed at the position where insufficient supply of adhesive tends to occur. For example, the spacer may be (partially) attached only at the center section of the thickness of the spine SA where insufficient supply of adhesive tends to occur to structure the storage section 514C so as not to generate insufficient supply of adhesive by temporary storing the adhesive scraped by the main scraping member 514A into the storing section 514C.

In the scraping section 524 (524A-524D) illustrated in FIG. 9(*b*), two metal bars having a diameter of several mm, a step structure being provided between these two metal bars, are provided so that the upper metal bar functions as a main scraping member 524A, the lower metal bar functions as auxiliary scraping member 524C and the case section functions as a storing section 524B.

As described above, adhesive is coated on the spine of a sheet bundle by a coating roller, and a scraping member for scraping the coated adhesive and a storing section for storing the scraped adhesive configure a bookbinding apparatus. Based on this configuration, it becomes possible to uniformly coat adhesive onto the spine of the sheet bundle. Further, it also becomes possible to provide a bookbinding apparatus for forming a high quality booklet and an image forming system including the bookbinding apparatus.

What is claimed is:

1. A bookbinding apparatus including an adhesive coating section which coats an adhesive onto a spine of a sheet bundle of a plurality of sheets, by relatively moving the adhesive coating section and the sheet bundle, wherein the bookbinding apparatus adheres a cover sheet onto the spine of the sheet bundle onto which the adhesive has been coated by the adhesive coating section, the adhesive coating section comprising:

(a) a coating member provided in an adhesive tank, which coats the adhesive stored in the adhesive tank onto the spine of the sheet bundle; and (b) a scraping section provided in the adhesive tank, which scrapes the adhesive coated onto the spine of the sheet bundle, wherein the scraping section comprises:

(i) a main scraping member;

(ii) an auxiliary scraping member disposed downstream of the main scraping member in a scraping direction; and (iii) a reservoir disposed between the main scraping member and the auxiliary scraping member which temporarily stores the adhesive scraped by the main scraping member;

wherein the adhesive temporarily stored in the reservoir is supplied to the spine of the sheet bundle.

2. The bookbinding apparatus of claim 1, wherein the scraping section comprises a folded plate member which integrally forms the main scraping member, the reservoir, and the auxiliary scraping member.

3. The bookbinding apparatus of claim 2, wherein the scraping section further comprises a lower edge portion which is configured to regulate a thickness of an adhesive layer on the coating member.

4. An image forming system comprising:

an image forming apparatus which forms an image on a sheet; and the bookbinding apparatus of claim 1, which forms a booklet by bundling a plurality of sheets ejected from the image forming apparatus.

* * * * *